US008235585B2

(12) United States Patent
Speichinger

(10) Patent No.: US 8,235,585 B2
(45) Date of Patent: Aug. 7, 2012

(54) FASTENING DEVICE FOR WRIST STRAPS

(75) Inventor: Ferdinand Speichinger, Neuhausen am Rheinfall (CH)

(73) Assignee: Richemont International S.A., Villars-sur-Glane (CH)

( * ) Notice: Subject to any disclaimer, the term of this patent is extended or adjusted under 35 U.S.C. 154(b) by 0 days.

(21) Appl. No.: 12/722,638

(22) Filed: Mar. 12, 2010

(65) Prior Publication Data

US 2010/0238770 A1 Sep. 23, 2010

(30) Foreign Application Priority Data

Mar. 19, 2009 (CH) ..... 0419/09

(51) Int. Cl.
*A44C 5/00* (2006.01)

(52) U.S. Cl. ..... 368/282; 224/177

(58) Field of Classification Search ..... 368/281–283; 24/265 R, 265 WS; 224/164–180
See application file for complete search history.

(56) References Cited

U.S. PATENT DOCUMENTS

| | | | | |
|---|---|---|---|---|
| 2,009,254 | A * | 7/1935 | Feid | 224/174 |
| 2,014,713 | A * | 9/1935 | Baker | 24/265 B |
| 2,820,275 | A | 1/1958 | Lancaster | |
| 3,581,960 | A | 6/1971 | Ojima | |
| 6,408,491 | B2 | 6/2002 | Guyard | |
| 7,575,368 | B2 * | 8/2009 | Guillaume | 368/282 |
| 2001/0016971 | A1 | 8/2001 | Guyard | |
| 2003/0002394 | A1 | 1/2003 | Kinkio et al. | |
| 2006/0261106 | A1 | 11/2006 | Hiranuma et al. | |

FOREIGN PATENT DOCUMENTS

| | | | |
|---|---|---|---|
| AT | 504872 | | 9/2008 |
| CH | 486 860 | | 3/1970 |
| CH | 685 464 | A3 | 7/1995 |
| CN | 1309938 | | 8/2001 |
| EP | 0 664 093 | A1 | 7/1995 |
| EP | 1 128 237 | A1 | 8/2001 |
| EP | 1 387 227 | A1 | 2/2004 |
| EP | 1 655 643 | A1 | 5/2006 |
| EP | 1 772 072 | A1 | 4/2007 |
| EP | 1 839 515 | A1 | 10/2007 |

(Continued)

*Primary Examiner* — Sean Kayes
(74) *Attorney, Agent, or Firm* — Patterson Thuente Pedersen Christensen, P.A.

(57) ABSTRACT

A device for fastening a wrist strap, in particular a watch strap, to a case, in particular to a watch case, the device having a linking member, to one end of which a strap end member of the wrist strap can be fastened and the other end of which can be fastened to a wrist strap pin attached laterally to said case. The linking member has at the bottom thereof an indentation which is appreciably elbowed in longitudinal section and opens into a groove which is suitable for receiving the wrist strap pin and is oriented transversely to the longitudinal axis of the wrist strap. A securing element, which is biased against said case and has an interlocking projection located therein, is arranged on the linking member in such a way that the securing element can assume two positions. In a first, secured position, the wrist strap pin is positioned in the groove in the linking member and the securing element prevents the linking member or the wrist strap from becoming detached from the wrist strap pin or from the case by means of the cooperation of said interlocking projection with the case. In a second, opened position, the wrist strap pin can be guided out of or into said groove.

13 Claims, 2 Drawing Sheets

FOREIGN PATENT DOCUMENTS

| | | | |
|---|---|---|---|
| EP | 1 995 651 | A2 | 11/2008 |
| FR | 2 686 713 | | 7/1993 |
| FR | 2 749 411 | | 12/1997 |
| FR | 2 766 587 | | 1/1999 |
| FR | 2 849 355 | | 7/2004 |
| FR | 2 893 153 | | 5/2007 |
| JP | 8000315 | | 1/1996 |
| JP | 2003043165 | | 2/2003 |
| JP | 3532962 | | 5/2004 |
| WO | WO 0062638 | | 10/2000 |

* cited by examiner

FASTENING DEVICE FOR WRIST STRAPS

RELATED APPLICATION

The present application claims priority to Swiss Application No. 0419/09 filed Mar. 19, 2009, which is incorporated herein in its entirety by reference.

TECHNICAL FIELD

The present invention relates to a device for fastening a wrist strap, in particular a watch strap, to a case, in particular to a watch case, the device having a linking member, to one end of which a strap end member of the wrist strap can be fastened and the other end of which can be fastened to a wrist strap pin attached laterally to said case.

BACKGROUND ART

Wrist straps, in particular watch straps, with a fastening device of the above-cited type have long been known. Fastening devices of this type are intended in this regard to allow wrist straps to be attached to and detached from a case in as simple a manner as possible. In relation to watch straps, in particular, there are a large number of mechanical solutions for exchanging the wrist strap attached to the watch case. This fact originates in that there are in everyday life a large number of situations in which the wearer of a wrist strap watch would like to exchange the wrist strap attached to the watch case. Examples of such situations include when the color of the wrist strap located on the watch clashes with the wearer's clothing, when a worn-out wrist strap is to be exchanged, or when the planned use of the watch is incompatible with the wrist strap currently fastened thereto, for example when a leather wrist strap is fastened to a diver's watch which the diver wishes to wear as he dives into the water or when a diver's watch is equipped with a wrist strap of normal length and is now to be worn over the diving suit and a longer wrist strap is therefore required. However, a corresponding need for wrist straps which can be exchanged rapidly and simply exists not only in relation to watches, but generally in each type of wrist strap which is mounted onto a case and has to be occasionally exchanged.

The known mechanical solutions for implementing an exchangeable wrist strap are based either on a relatively simple design principle, but require tools for attaching or detaching the wrist strap to/from the case, or allow the wrist strap to be exchanged without tools, albeit at the cost of a relatively complex design which subsequently, again, increases the production costs.

In relation to watch wrist straps which can be exchanged without tools, in particular, the system according to French patent FR 2 893 153 is for example known. The exchangeable watch strap proposed in said document uses a spring pin of variable diameter and also a corresponding end piece on the wrist strap, these two parts being shaped in a relatively complex manner and therefore being expensive to produce. In addition, this system does not prevent accidental opening and corresponding accidental detaching of the wrist strap from the watch case.

A further watch wrist strap of this type that can be exchanged without tools is presented in European patent specification EP 1 128 237. The watch wrist strap according to this document has an end piece with lateral projections which can be vertically inserted into corresponding guide channels of the lugs embodied on the watch case, a securing lever preventing the end piece from accidentally sliding out between the lugs in cooperation with a blocking face embodied laterally on the watch case. However, this design is not only based on a specific, wrist strap-side configuration of the end piece thereof, but also requires considerable alterations of the watch case or generally of the case to which the wrist strap is to be fastened. In particular, the lugs of the case have to be equipped with said guide channels; in the case of watches, this inevitably necessitates the elimination of the spring pin which is generally used there. A system of this type therefore cannot be used with most commercially available watch cases without considerable modification thereof.

Therefore, there is still a need for a relatively simply designed embodiment of an exchangeable wrist strap, which at the same time functions without tools, in particular for the watch sector, wherein this exchangeable wrist strap must satisfy the criteria with regard to aesthetics, ergonomics, wearer comfort, robustness, protection against accidental detachment, and also hygiene by way of simple cleaning of the system.

SUMMARY OF THE INVENTION

The present invention implements an exchangeable wrist strap of this type while avoiding the aforementioned drawbacks of the previously known systems. The present invention encompasses a wrist strap fastening device having the characterizing features mentioned in claim 1, and also a corresponding watch strap and watch having such a wrist strap fastening device.

The wrist strap fastening device hereof includes a linking member, the linking member having at the bottom thereof an indentation which is appreciably elbowed in longitudinal section and opens into a groove which is suitable for receiving the wrist strap pin and is oriented transversely to the longitudinal axis of the wrist strap, and further includes a securing element, which is biased against the case and has an interlocking projection located therein, arranged on the linking member in such a way that the securing element can assume two positions corresponding respectively to a secured position of the wrist strap and an opened position for attaching or for detaching the wrist strap.

The provision of the specifically shaped indentation and also of the correspondingly arranged securing element allows a wrist strap to be exchanged without tools only on the wrist strap side. This design therefore eliminates the need to carry out functional alterations on the case side, so that the system according to the present invention can be used with all conventional commercial watch cases having a wrist strap pin. In addition, the presence of an indentation which is relatively simple to produce and also of just one single movable part, the securing element, means that the device is comparatively simple and inexpensive to produce. Furthermore, the proposed solution meets, as will be described hereinafter in greater detail, the above-mentioned criteria, in particular with regard to robustness, safety, ergonomics and wearer comfort.

The linking member can consist of an abutment member which is produced in one part, or of two separately produced abutment members which are movably fastened to each other. This allows maximum possible aesthetic, ergonomic and also application-based flexibility of the fastening device according to the invention.

In particular, in corresponding embodiments of the wrist strap fastening device according to the invention, the above-mentioned securing element can be embodied as a pivotable or displaceable lever which is loaded by a spring against the case or as a spring element which is securely attached to the linking member and biased against the case, depending on whether the aesthetics, the simplicity of design or the production costs of the system are the key factor.

Furthermore, the device according to the invention is distinguished in that the force, exerted by the interlocking projection of the securing element on the case, for interlocking the linking member on the wrist strap pin or the wrist strap on the case and also the tensile and torsional forces exerted on the wrist strap pin during wearing of the wrist strap are positioned appreciably at right angles to the force necessary for actuating the securing lever. This has the advantage that it will normally not be possible for the securing lever to be opened accidentally, and also that only the relatively low forces necessary for interlocking act on the securing element, whereas the tensile forces, occurring during wearing of the wrist strap, between the wrist strap and the case are absorbed by the spring pin, such as is the norm, in particular in watch cases.

The wrist strap fastening device hereof can be used in any desired wrist strap which is to be fastened to a case, in particular in watch wrist straps, whatever material these may be made of. Accordingly, the system can be used in any watch having a watch case with two lugs to which a wrist strap pin is attached securely or in a detachable manner. However, as the range of use is not only limited to watches, but includes any wrist strap which is to be fastened to a case carrying, for example, a gemstone, an image or another object, the system according to the invention can therefore be used in an overall extremely flexible manner.

BRIEF DESCRIPTION OF THE DRAWINGS

The appended figures illustrate, by way of example, two embodiments of a device for fastening a wrist strap according to the present invention.

DETAILED DESCRIPTION OF THE DRAWINGS

Two embodiments of the invention will now be described in detail with reference to the aforementioned figures. The wrist strap fastening device according to the invention will in this regard be presented in particular in relation to a watch strap which is to be fastened to a watch case although, as stated hereinbefore, a device of this type can easily be mounted onto any desired case and the following account in relation to watch straps is therefore not in any way intended to restrict the scope of application of the invention.

Figure 1A:
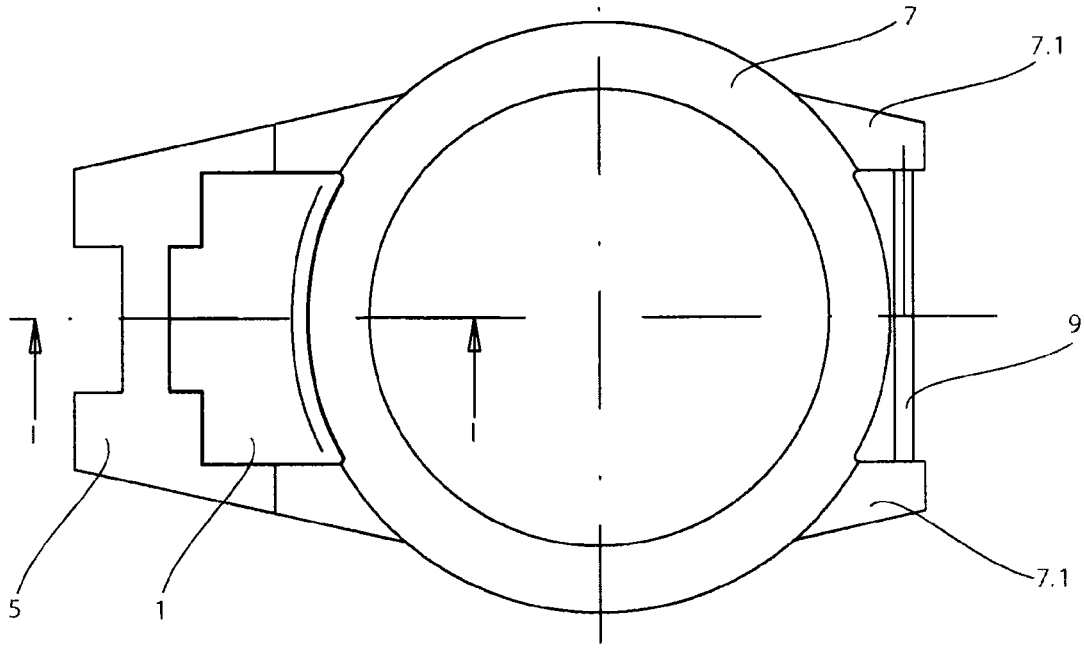
FIG. 1*a* is a schematic and exemplary plan view of a first embodiment of a wrist strap fastening device according to an embodiment of the invention that is attached to a watch case.

FIG. 1*a* is a schematic and exemplary plan view of a first embodiment of a device according to the invention for fastening a wrist strap to a case 7, in particular a watch strap to a watch case. The device has a linking member 1, to one end of which a strap end member 5 of the wrist strap can be fastened and the other end of which can be fastened to a wrist strap pin 9 attached laterally to the case 7. As may be seen in detail from FIG. 1*b*, which is a section along the longitudinal axis of the wrist strap or the device according to the invention, i.e. along the line I-I plotted in FIG. 1*a*, the strap end member 5 of the wrist strap can be pivotably fastened to the linking member 1 of the device, for example in the conventional manner by means of a strap member shaft 6. The wrist strap itself (not shown in the figures) is, for example, fastened to the strap end member 5 and can be made of metal, of leather, of rubber or of any other material suitable for this purpose, such as for example synthetic material such as plastic or another plastics material. The case 7 shown in FIGS. 1*a* and 1*b* consists of a normal watch case with two laterally attached lugs 7.1 to which a wrist strap pin 9 is attached securely or in a detachable manner, for example in the form of a spring pin known to the person skilled in the art. However, as mentioned hereinbefore, the case does not necessarily have to consist of a watch case, but can serve any other purpose, provided that it is equipped with a part corresponding to the wrist strap pin 9.

The configuration of the side of the device according to the invention that faces the spring pin 9 of the case 7 for fastening a wrist strap and will be described hereinafter in greater detail. The linking member 1 of the device has for this purpose, on the one hand, at the bottom thereof, that is to say at its side facing the spring pin 9 and also the bottom 8 of the case, an indentation 1.1 which is appreciably elbowed in longitudinal section, as is shown in particular in FIG. 1*b* which is in the form of a longitudinal section with a partial side view. The first part of the appreciably elbowed indentation 1.1 can in this regard be formed, as may be seen from FIG. 1*b*, for example by the wall of the portion accommodating the strap member shaft 6 and also by the wall opposing this wall, thus forming between these two walls a type of guide channel, the width of which appreciably corresponds to the diameter of the spring pin 9. This guide channel opens, in a second part of the appreciably elbowed indentation 1.1, into a groove 1.2 which is formed appreciably at right angles to the guide channel, is suitable for receiving the wrist strap pin 9 and is also oriented, like the aforementioned guide channel, transversely to the longitudinal axis of the wrist strap. In its width and preferably also in its depth, the groove 1.2 likewise corresponds appreciably to the diameter of the spring pin 9 and serves, as will become clearer hereinafter, as a retaining groove for the spring pin 9. On the other hand, the linking member 1 has, as may also be seen from FIG. 1*b*, a securing element 2 which is biased against the case 7, the securing element 2 being, for example, pivotably mounted to the linking member 1 by means of a shaft 3 attached parallel to the aforementioned groove 1.2.

In general, the securing element 2 also has an interlocking projection 2.1 which is oriented in the direction of the case 7 and is arranged on the linking member 1 in such a way as to be able to assume two positions. These two positions correspond, on the one hand, to a first, secured position, in which the wrist strap pin 9 is positioned in the groove 1.2 in the linking member 1 and the securing element 2 prevents the linking member 1 or the wrist strap from becoming detached from the wrist strap pin 9 or from the case 7 by means of the cooperation of the said interlocking projection 2.1 with the case 7 (see FIG. 1*b*), and a second, opened position in which the wrist strap pin 9 can be guided out of or into said groove 1.2.

Figure 1B:
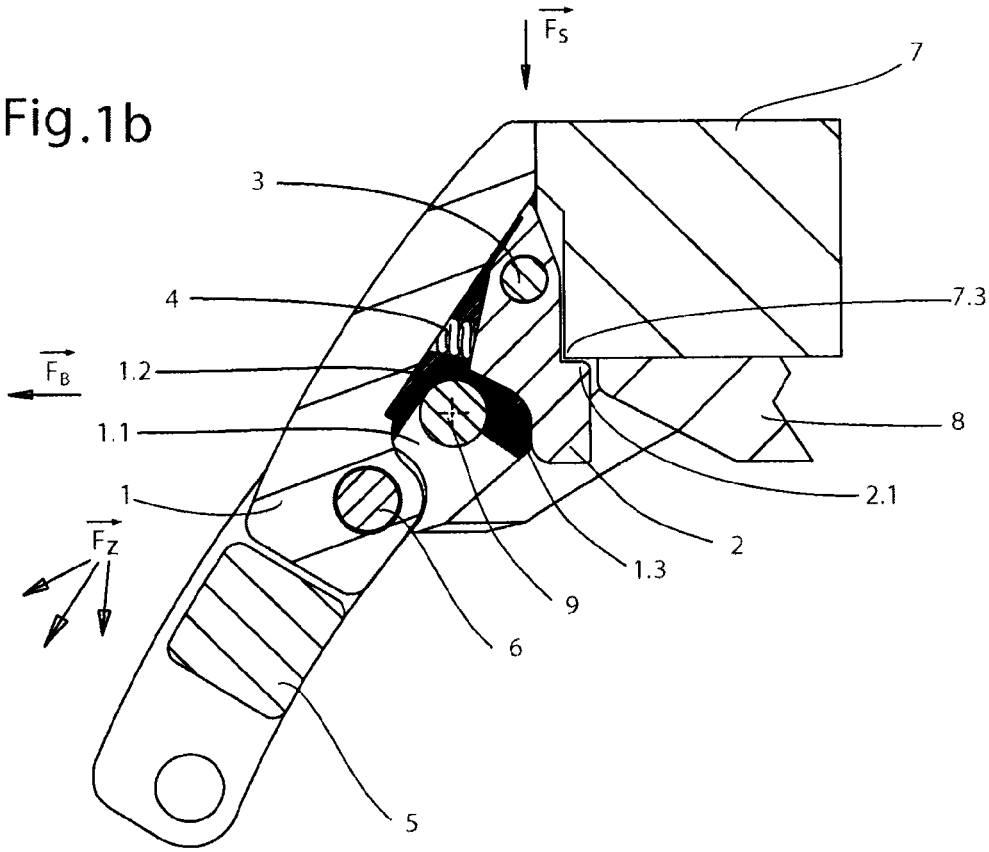
FIG. 1*b* is a longitudinal section along the line I-I of FIG. 1 a invention.

As may be seen from FIG. 1*b*, in particular, the linking member 1 of the device according to the invention is preferably embodied so as to be appreciably U-shaped in cross section, the shaping of the central part of the linking member 1 being appreciably adapted to the shape of the case 7 between the lugs 7.1, while the lateral arms or jaws 1.3 of the linking member 1 nestle against the inner side faces of the lugs 7.1. These lateral arms of the linking member 1 are embodied at the bottom thereof and therefore face the wrist strap pin 9 of the case 7, so that in this embodiment of the device the said elbowed indentation 1.1 is shaped with the groove 1.2, which is oriented transversely to the longitudinal axis of the wrist strap, in these two arms 1.3. Furthermore, a hollow space, which is ideally suited to receiving the said securing element 2, is formed between these two arms 1.3. The above-mentioned shaft 3 for pivotably fastening the securing element 2 to the linking member 1 can therefore also be secured or mounted so as to be able to rotate freely in the two lateral arms 1.3 of the linking member 1. In addition, in this hollow space, a resilient element, for example a compression spring 4, for instance in the form of a spiral spring, can be arranged between the linking member 1 and the securing element 2 for spring loading the securing element 2 in the direction of the case 7. In addition, with regard to the configuration of the linking member 1, it should be noted with reference to FIGS. 1*a* and 1*b* that the linking member 1 according to the present invention generally has an upper side, the shape of which is complementary to that of the case 7, so that the linking member 1 and the case 7 form a substantially unitary, continuous surface. This allows the wrist strap fastening system according to the invention to be able to be configured in an extremely advantageous manner in terms of aesthetics and ergonomics, in particular in the case of a watch wrist strap.

It is also possible to specify with the aid of FIG. 1*b* that the said interlocking projection 2.1 of the securing element 2 of a device according to the invention is arranged in the direction and at the level of the case lower edge 7.3 of the case 7. As a result, in the first, secured position of the securing element 2, the interlocking projection 2.1 reaches below the case edge 7.3 of the case 7 and thus prevents the linking member 1 from in any way moving in a manner which is directed toward the upper side of the case and might cause the linking member 1 to become detached from the wrist strap pin 9. In the second, opened position of the securing element 2, the interlocking projection 2.1 releases the lower edge 7.3 of the case and allows as a result a movement, which will be described more precisely hereinafter, for detaching the linking member 1 from the wrist strap pin 9 or for attaching the linking member to this pin. As a result of this configuration of the securing element 2 or the interlocking projection 2.1 located thereon, the force $\vec{F}_S$, exerted by the securing element 2 on the case 7, for securing or interlocking the linking member 1 on the wrist strap pin 9 or the wrist strap on the case 7 is oriented appreciably at right angles to the plane of the case 7, whereas the tensile and torsional forces $\vec{F}_Z$ exerted on the wrist strap pin during wearing of the wrist strap are oriented as a function of the respective size of the wrist of the person wearing the watch, roughly in the longitudinal direction of the wrist strap. These forces are directed against various parts of the case, namely, on the one hand, against the lower edge 7.3 of the case and also, on the other hand, against the wrist strap pin 9. Furthermore, the force $\vec{F}_B$ for actuating the securing lever, allowing the linking member 1 to be detached from the wrist strap pin 9 or the wrist strap to be detached from the case 7, is positioned substantially perpendicularly to the direction of the aforementioned interlocking force $\vec{F}_S$, and possibly also of the tensile forces $\vec{F}_Z$. The orientation of the forces which occur is indicated symbolically by means of arrows in FIG. 1*b*. This has the advantage that it will normally not be possible for the securing lever 2 to be opened accidentally. In addition, during wearing of the wrist strap, the appreciably higher tensile forces are absorbed as normal by the wrist strap pin 9 and not transmitted to the securing element 2 which itself absorbs only the much lower interlocking force $F_S$. Should it nevertheless occur in exceptional situations that the securing lever 2 is actuated accidentally, then the specific shape of the indentation 1.1, which acts like a hook, will generally still prevent the linking member 1 from becoming detached from the wrist strap pin 9; in particular, this has also been confirmed by tests in which the test subject wears a watch equipped with a wrist strap according to the invention.

Figure 2A:
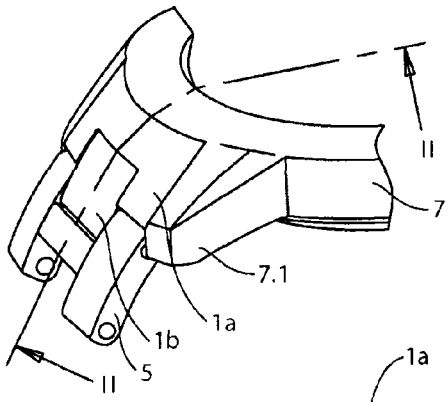
FIG. 2*a* is a perspective view of a second embodiment of a wrist strap fastening device according to the invention, said wrist strap fastening device being joined to the case.
Figure 2B:
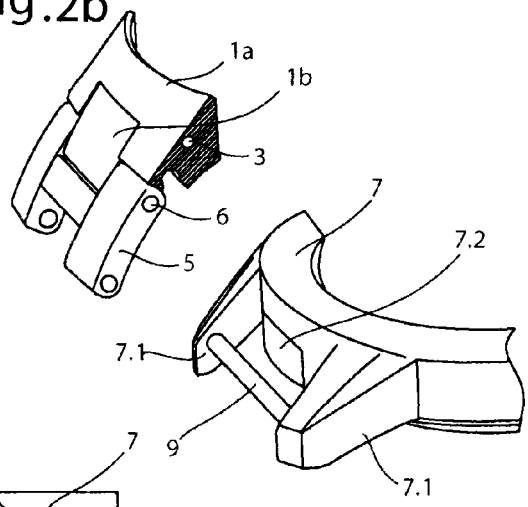
FIG. 2*b*, is similar to FIG. 2*a*, but with the fastening device detached from the case.
Figure 2C:
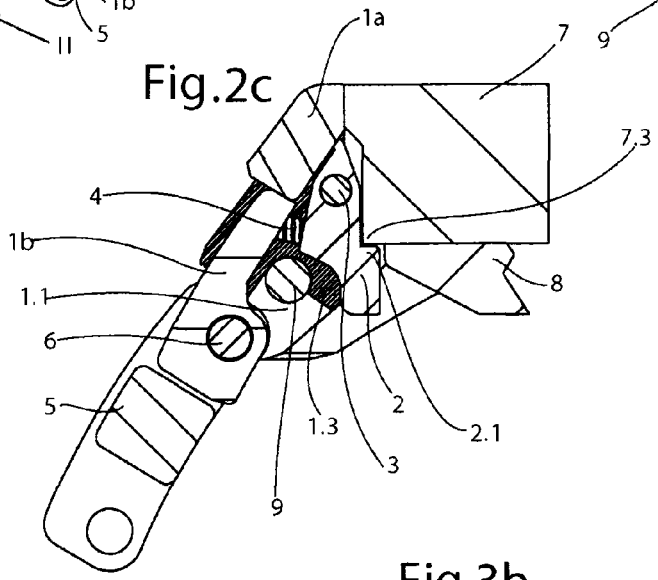
FIG. 2*c* is a longitudinal section, similar to FIG. 1*b*, along the line II-II of FIG. 2*a*.

A second embodiment of a wrist strap fastening device according to the invention will now be described with reference to FIGS. 2*a* to 2*c*. The main difference between the second embodiment shown in these figures and the first embodiment shown in FIGS. 1*a* and 1*b* is that the linking member in this instance is two separately produced abutment members 1*a*, 1*b* which are movably fastened to each other, whereas in the first embodiment of the device according to the invention the linking member is an abutment member 1 which is produced in one part. As may be seen for instance from FIG. 2*c*, which is a longitudinal section with a partial view, in this second embodiment the shaft 3 for pivotably fastening the securing element 2 to the first abutment member 1*a* can for example at the same time be used to pivotably fasten the second abutment member 1*b* to the first abutment member 1*a*, as a result of which the linking member 1 is implemented as a two-membered abutment piece. As may be seen from FIG. 2*c*, in particular, the elbowed indentation 1.1 is in this instance formed partly, for example with regard to the above-mentioned guide channel oriented appreciably at right angles to the groove 1.2, by the cooperation of the abutment members 1*a* and 1*b*. Otherwise, this embodiment is constructed in a manner similar to the first embodiment of the device according to the invention.

In the two embodiments, a detailed account of which has been given hereinbefore, of a wrist strap fastening device according to the invention, the securing element 2 is embodied as a pivotable lever which is loaded by a spring against the case 7. Pressing by hand on the interlocking projection 2.1, which protrudes slightly from the bottom of the linking member 1 and, in the assembled state, also from the bottom of the bottom 8 of the case 7, enables the securing element 2 to be brought from its first, secured rest position, counter to the spring loading force, into its second, opened position allowing attachment or detachment of the linking member 1 or the wrist strap to/from the wrist strap pin 9 or the case 7. Depending on the specific configuration of the case 7, for example on whether said case is more rectangular or more circular, it may be advantageous, in particular in the latter case, for the side wall of the case 7 to be provided with a flat recess 7.2 to improve the mode of operation of the securing lever 2. This is a comparatively minor and inexpensive intervention into existing cases in order to bring the cases into line with the fastening device according to the invention, this intervention being necessary only in specific shapes of cases. In addition, the above-described opening and interlocking function of the securing element 2 can be implemented mechanically and also in a different manner; this may eliminate the need for this intervention. Two alternative solutions, which are not explicitly illustrated in the figures, will now be described briefly.

On the one hand, instead of being a lever which is pivotably attached to the linking member 1 by means of a shaft 3 and is acted on by a spring against the case 7, the securing element 2 could also be embodied directly as a spring element which is securely attached to the linking member 1 and biased against the case 7. In particular, use could be made for this purpose of a leaf spring which is attached to the linking member 1 instead of the lever 2 shown in FIGS. 1*b* and 2*c* and at the free end of which the said interlocking projection 2.1 is embodied. Dispensing with the shaft 3 and also the compression spring 4, compared to the embodiments illustrated in FIGS. 1*b* and 2*c*, would make this variant of a device according to the invention mechanically simpler in its conception, whereas the embodiments described at the outset have advantages in terms of design and ergonomics.

A further alternative embodiment consists in embodying the securing element 2 as a displaceable pusher which is loaded by a spring against the case 7. In this instance, the pusher, which is for example displaceably attached in the hollow space of the linking member 1, would be able to perform, instead of a pivoting movement, a movement of displacement, which is guided by means of corresponding guides in the lateral arms 1.3 of the linking member 1, in the direction of the case and away therefrom, wherein a corresponding compression spring would preload the pusher in the direction of the case 7. In this instance too, the securing element 2, which consists of the displaceable pusher and the compression spring pertaining thereto, could, like the aforementioned pivotable lever, be replaced by a corresponding, one-part resilient element.

Figure 3A:
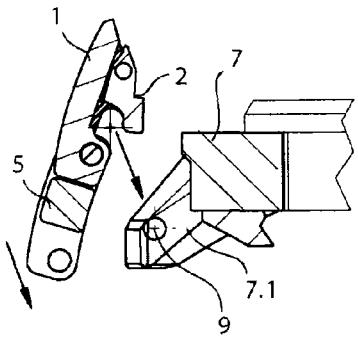
FIGS. 3*a*, 3*b* and 3*c* illustrate schematically and sequentially the attachment of a wrist strap fastening device according to an embodiment of the invention to a case, without tools.
Figure 3B:
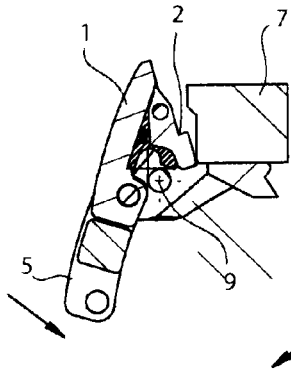
Figure 3C:
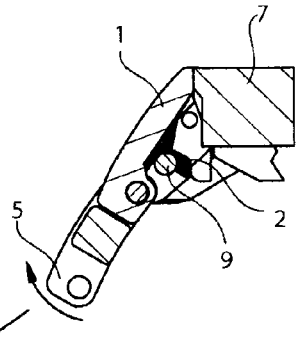

The mode of operation of detaching and attaching a wrist strap equipped with the device according to the invention to a case without tools will now be described by means of FIGS. 3*a*, 3*b* and 3*c*. As is illustrated schematically and by way of example in FIG. 3*a*, for attaching the device according to the invention to a case 7, the linking member 1 is firstly brought up to the case 7 from above in the direction of the wrist strap pin 9. As soon as the spring pin 9 of the case 7 enters the opening in the above-mentioned guide channel of the elbowed indentation 1.1 on the linking member 1, the spring pin 9 is firstly guided along this guide channel and then, by way of a corresponding rotation of the linking member 1 or the wrist strap fastened thereto appreciably at right angles to the first phase of the movement, inserted into the groove 1.2, such as is symbolically indicated by means of arrows in FIGS. 3*a*, 3*b* and 3*c*. In this regard, the securing element 2 is deflected out of its rest position and counter to its spring loading as a result of the interlocking projection 2.1 striking the side wall of the case 7. However, the securing element 2 automatically resumes its secured rest position as soon as the wrist strap pin 9 of the case 7 enters the groove 1.2 in the elbowed indentation 1.1 in the linking member 1 provided that the interlocking projection 2.1 can reach below the case lower edge 7.3 of the case 7 at this moment. In this position of the securing element 2, the linking member 1 or the wrist strap fastened thereto is protected against detachment and in particular accidental detachment of the wristband from the case 7, as the securing element 2 impedes by means of the interlocking projection 2.1 a movement of the linking member 1 in the vertical direction upward that is required for detaching the linking member 1 from the wrist strap pin 9. Although not explicitly illustrated by the figures, it will be clear from the foregoing that the linking member 1 is detached from the wrist strap pin 9 or a wrist strap fastened to the linking member 1 is detached from the case 7 by pressing on the securing element 2 by hand, as a result of which the interlocking projection 2.1 firstly releases the lower edge 7.3 of the case and the aforementioned movement of the linking member 1 in the direction turned appreciably vertically upward relative to the bottom 8 of the case 7 is thus made possible. Finally, subsequent slight rotation of the linking member 1 or the wrist strap fastened thereto through approximately 90 degrees and also a further translational movement of the linking member 1 along the orientation of the aforementioned guide channel of the elbowed indentation 1.1 which is oriented appreciably at right angles to the groove 1.2 thereof, allow the linking member 1 or the wrist strap fastened thereto to be detached from the wrist strap pin 9 or from the case 7.

The device according to the invention therefore allows extremely simple handling and elegantly implements a system for detaching and attaching a wrist strap from/to a case, in particular a watch wrist strap on a watch case, without tools.

It will also be clear from the foregoing that the present invention also relates, in particular, to a watch strap having a device according to the invention for fastening a wrist strap and also to a watch with a corresponding wrist strap.

The foregoing, detailed description of the wrist strap fastening device according to the invention makes it clear that the present invention allows in an optimum manner a wrist strap to be enabled to be exchanged without tools by way of simply designed configurational features which are positioned only on the case side, without the need for alterations on the case side. The system according to the invention therefore has the advantage, in particular, of being able to be used with all conventional commercial cases, above all watch cases, having a wrist strap pin. The comparatively simple design, which is based on a specifically shaped indentation in combination with a corresponding securing element, makes the device or a corresponding wrist strap relatively simple and inexpensive to produce. Furthermore, as a result of the fact that the tensile and interlocking forces which occur are oriented toward various parts of the case and substantially perpendicularly to the direction of the force for actuating the securing lever, the device according to the invention satisfies in an exemplary manner the criteria placed on safety and robustness of a system of this type. In so far as there is broad latitude for configuring the shape and the composition, particularly of the surface of the linking member of the device according to the invention, the aesthetics, the ergonomics and the wearer comfort of a wrist strap equipped with a fastening device according to the invention may be said to be further advantages of the present invention.

The invention claimed is:

1. A device for fastening a wrist strap to a case, the wrist strap presenting a longitudinal wrist strap axis, the device having a linking member, to one end of which a strap end member of the wrist strap can be fastened and the other end of which can be detachably fastened to a wrist strap pin attached to said case, said wrist strap pin presenting a wrist strap pin axis oriented transversely with respect to said wrist strap longitudinal axis when said linking member is detachably fastened to said wrist strap pin, wherein the linking member defines an indentation, the indentation comprising a guide channel for guiding the wrist strap pin and a groove for receiving the wrist strap pin, the groove being oriented generally parallel to said wrist strap pin axis when said linking member is detachably fastened to said wrist strap pin and being longitudinally offset from said guide channel along the longitudinal axis of the wrist strap such that said indentation is bent in longitudinal cross section, and wherein a securing element, which is biased against said case and has an interlocking projection located therein, is arranged on the linking member in such a way that the securing element can assume two positions, a first, secured position, in which the wrist strap pin is positioned in the groove in the linking member and the securing element inhibits the linking member or the wrist strap from becoming detached from the wrist strap pin or from the case by means of the cooperation of said interlocking projection with the case, and a second, opened position in which the wrist strap pin can be guided out of or into said groove.

2. The device as claimed in claim 1, wherein said linking member comprises an abutment member which is produced as one part, or as two separately produced abutment members which are movably fastened to each other.

3. The device as claimed in claim 1, wherein said linking member comprises two arms defining a hollow space between said two arms, and said securing element is positioned in the hollow space between said two arms, the two arms further defining the indentation.

4. The device as claimed in claim 1, wherein said linking member has an upper side the shape of which is complementary to that of the case, in such a way that the linking member and the case form a substantially unitary, continuous surface.

5. The device as claimed in claim 1, wherein said securing element is embodied as a pivotable lever which is loaded by a spring against the case.

6. The device as claimed in claim 5, wherein the spring loading of the securing element in the direction of the case is implemented by at least one resilient element arranged between the linking member and the securing element, the at least one resilient element comprising a spiral spring.

7. The device as claimed in claim 1, wherein said securing element is embodied as a displaceable pusher which is loaded by a spring against the case.

8. The device as claimed in claim 1, wherein said interlocking projection of the securing element is embodied as a projection arranged in the direction and at the level of the lower edge of the case in such a way that, in the first, secured position of the securing element, the projection reaches below the lower edge of the case and prevents the linking member from moving, in a manner directed toward the upper side of the case, for detaching the linking member from the wrist strap pin and wherein, in the second, opened position of the securing element, the projection releases the lower edge of the case and said movement for detaching the linking member is possible.

9. The device as claimed in claim 1, wherein the force ($F_S$), exerted by the interlocking projection of the securing element on the case, for interlocking the linking member on the wrist strap pin respectively the wrist strap on the case and also the tensile and torsional forces ($F_Z$) exerted on the wrist strap pin during wearing of the wrist strap are directed appreciably at a right angle to the force ($F_B$) necessary for actuating the securing lever.

10. The device as claimed in claim 1, the device comprising the wrist strap, the wrist strap comprising a watch strap.

11. The device as claimed in claim 10, wherein the watch strap is made of metal, of leather, of rubber or of synthetic material.

12. The device as claimed in claim 10, further comprising the case, the case comprising a watch case.

13. The device as claimed in claim 12, wherein the watch case has two lugs to which the wrist strap pin is attached securely or attached in a detachable manner.

* * * * *